United States Patent [19]

Marlow

[11] 4,126,711

[45] Nov. 21, 1978

[54] CHARGE PATTERN DEVELOPMENT METHOD AND APPARATUS

[75] Inventor: Richard Z. Marlow, London, England

[73] Assignee: Xerox Corporation, Stamford, Conn.

[21] Appl. No.: 610,356

[22] Filed: Sep. 4, 1975

[30] Foreign Application Priority Data

Sep. 24, 1974 [GB] United Kingdom ..... 41415/74

[51] Int. Cl.[2] ..... G03G 13/10; G03G 15/10

[52] U.S. Cl. ..... 427/15; 118/659; 346/75; 346/153; 361/228; 355/10; 427/24

[58] Field of Search ..... 427/15, 24; 346/74 J, 346/75, 153, 159; 118/DIG. 23, 659, 629; 355/10; 361/228, 226, 227; 101/DIG. 13

[56] References Cited

U.S. PATENT DOCUMENTS

| | | | |
|---|---|---|---|
| 2,633,796 | 4/1953 | Pethick | 346/74 J |
| 2,858,798 | 11/1958 | Sedlacsik | 239/15 X |
| 3,068,115 | 12/1962 | Gundlach | 427/15 |
| 3,176,653 | 4/1965 | Hansen | 118/637 |
| 3,298,030 | 1/1967 | Lewis et al. | 346/159 |
| 3,560,204 | 2/1971 | Damm | 96/1 LY |
| 3,576,623 | 4/1971 | Snelling | 96/1 LY |
| 3,656,173 | 4/1972 | Fussel | 346/74 ES |
| 3,673,601 | 6/1972 | Hertz | 346/75 |
| 3,810,193 | 5/1974 | Metcalfe et al. | 346/74 ES |
| 4,068,585 | 1/1978 | Thompson | 346/153 |

FOREIGN PATENT DOCUMENTS

| | | | |
|---|---|---|---|
| 40-18178 | 8/1965 | Japan | 427/15 |
| 43-27580 | 11/1968 | Japan | 427/15 |

*Primary Examiner*—Michael F. Esposito
*Assistant Examiner*—Stuart D. Frenkel
*Attorney, Agent, or Firm*—James J. Ralabate; Sheldon F. Raizes; Leonard Zalman

[57] ABSTRACT

A liquid developer is presented to a charge pattern on a photoconductor surface as an evenly distributed array of droplets passing tangentially to it. The droplets emanate from a series of jets and are spread into an even pattern electromagnetically. The charge pattern is developed by the droplet which it draws to the photoconductor surface.

14 Claims, 3 Drawing Figures

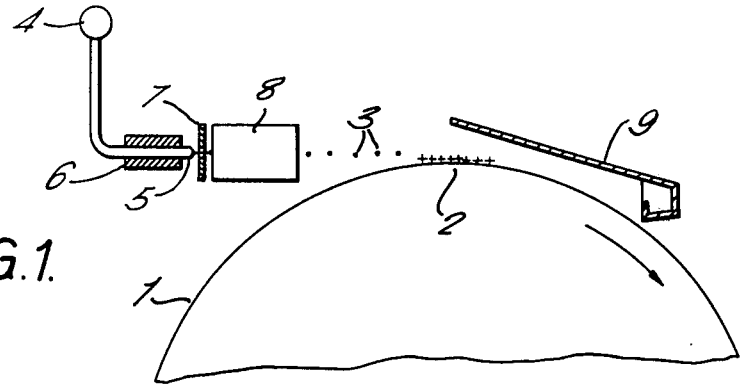
FIG. 1.
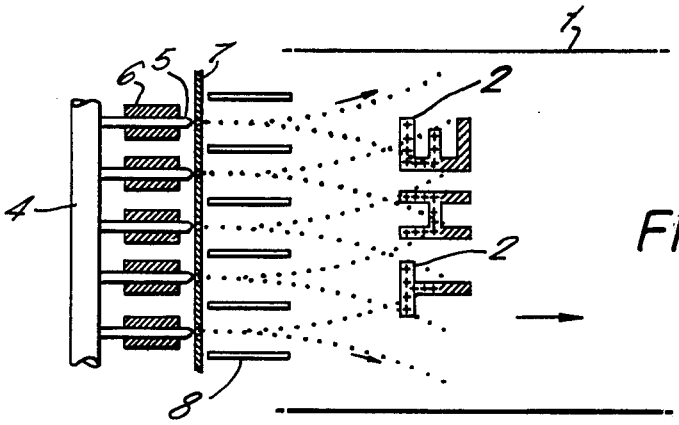
FIG. 2.
FIG. 3.
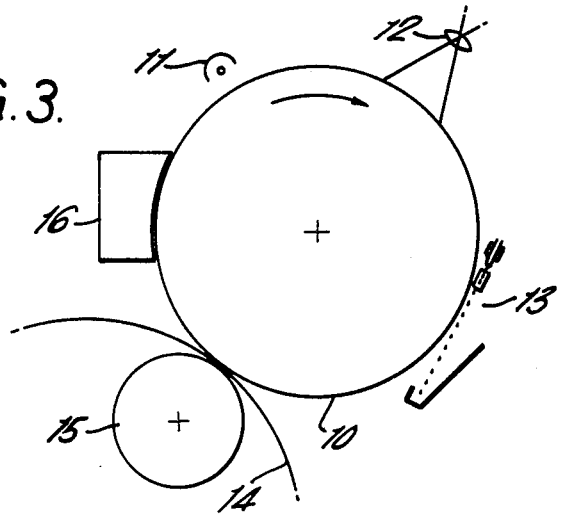

CHARGE PATTERN DEVELOPMENT METHOD AND APPARATUS

BACKGROUND OF THE INVENTION

The invention relates to developing charge patterns.

The formation and development of images on an imaging surface which may be the surface of a photoconductor, by electrostatic means is well known. The basic xerographic process, as disclosed by C. F. Carlson in U.S. Pat. No. 2,297,691 involves placing a uniform electrostatic charge on a phonoconductive insulating layer, exposing the layer to a light-and-shadow image to dissipate the charge on the areas of the layer exposed to the light, and developing the resulting charge pattern by depositing on the image a finely-divided marking material referred to in the art as "toner". The toner will normally be attracted to those areas of the layer which retain a charge, thereby forming a toner image corresponding to the charge image. This powder image may then be transferred to a support surface such as paper. The transferred image may subsequently be permanently affixed to a support surface as by heat. Instead of latent image formation by uniformly charging a photoconductive layer and then exposing the layer to a light-and-shadow image, one may form the charge pattern by directly charging an image surface in image configuration. The powder image may be fixed to the imaging surface if elimination of the powder image transfer step is desired. Other suitable means such as solvent or overcoating treatment may be substituted for the foregoing heat fixing steps.

Several methods are known for applying a developer to a charge pattern to be developed. One development method as disclosed by E. N. Wise in U.S. Pat. No. 2,618,552 is known as "cascade" development. Another method of developing charge patterns is the "magnetic brush" process as disclosed for example, in U.S. Pat. No. 2,874,063. Still another development technique is the "powder cloud" process as disclosed by C. F. Carlson in U.S. Pat. No. 2,221,776.

An additional dry development system involves developing a charge pattern with a powdered developer material, the powder having been uniformly applied to the surface of a powder applicator. The charge pattern is brought close enough to the developer powder applicator so that the developer powder is pulled from the powder applicator to the charge bearing surface in image configuration. The charge pattern and powder applicator may desirably be brought in contact including contact under pressure to affect development. The powder applicator may be either smooth surfaced or roughened so that the developer powder is carried in the depressed portions of the patterned surface. Exemplary of this system are the techniques disclosed by H. G. Greig in U.S. Pat. No. 2,811,465.

Liquid development may also be employed in the development of charge patterns. In conventional liquid development, more commonly referred to as electrophoretic development, an insulating liquid vehicle having finely divided solid material dispersed therein contacts the imaging surface in both charged and uncharged areas. Under the influence of the electric field associated with the charged image pattern the suspended particles migrate toward the charged portions of the imaging surface separating out of the insulating liquid. The electrophoretic migration of charged particles results in the deposition of the charged particles on the imaging surface in image configuration.

An additional liquid technique for developing charge patterns is the liquid development process disclosed by R. W. Gundlach in U.S. Pat. No. 3,084,043. In this method, a charge pattern is developed or made visible by presenting to the imaging surface a liquid developer on the surface of a developer dispensing member having a plurality of raised portions defining a substantially regular patterned surface and a plurality of portions depressed below the raised portions. The depressed portions contain a liquid developer which is maintained out of contact with the imaging surface. When the raised areas of the developer applicator are brought into contact with the imaging surface bearing a charge pattern the developer creeps up the sides of raised portions in contact only with the charged area of the imaging surface, and is deposited thereon.

This technique is to be distinguished from conventional liquid development wherein there is an electrophoretic movement of charged particles suspended in a liquid carrier vehicle to the charged portion of the image bearing surface while the liquid substantially remains on the applicator surface and serves only as a carrier medium. In the liquid development method described by R. W. Gundlach in U.S. Pat. No. 3,084,043 the liquid phase actively takes part in the development of the image since the entire liquid developer is attracted to the charged portions of the image bearing surface. Furthermore in the liquid development method described by R. W. Gundlach, unlike conventional liquid development, the developer liquid contacts only the charged portions of the image bearing surface.

A further liquid development technique is that referred to as "wetting development" or selective wetting described in U.S. Pat. No. 3,285,741. In this technique, an aqueous developer uniformly and continuously contacts the entire imaging surface and due to the selected wetting and electrical properties of the developer substantially only the charged areas of the normally hydrophobic imaging surface are wetted by the developer. The developer should be relatively conductive having a resistivity generally from about $10^5$ to $10^{10}$ ohm. cm. and have wetting properties such that wetting angle measured when the developer is placed on the imaging surface is smaller than 90° at the charged areas and greater than 90° in the uncharged areas.

"Ink jets" or "ink spitters" are known to be useful for marking a recording surface with a liquid, typically in response to electrical or mechanical input which controls the trajectory of a droplet of liquid. Liquids are also applied in marking fashion to surfaces by means of a stylus which may be mechanically or electrically controlled. Such methods of marking a recording surface with a liquid are described in U.S. Pat. No. 3,573,846; 3,786,517 and 3,369,252 and in U. K. Pat. No. 1,064,344.

Although capable of marking a recording surface, the prior art systems relating to "ink jets" and to styli generally require complex systems of electrical and mechanical input to direct the ink droplets or the stylus. Additionally, the control of the "ink jets" or of the stylus must in many cases be synchronized with the movement of the recording surface.

Although such methods of developing a charge pattern with a liquid and of marking a recording surface with a liquid are capable of producing acceptable images, these methods each have several undesirable aspects which are sought to be overcome. The electrophoretic and wetting development methods of developing a charge pattern involve contact of the entire recording surface with the development liquid. Such complete contact is sometimes undesirable. The development method of R. W. Gundlach contemplates close tolerances between the developer applicator and the imaging surface. Obtaining such tolerances can be undesirably expensive and troublesome. As indicated above, the "ink jet" and stylus methods of marking with a liquid generally use undesirably complex and expensive electrical or mechanical methods of controlling the trajectory of a liquid droplet or the movement of a stylus in response, for example, to optical input.

It can be seen that a simple, inexpensive means and apparatus for marking with a liquid which overcomes the disadvantages of the prior art is desirable. Such a means and apparatus should desirably produce images of high resolution and good density on an imaging surface with a minimum of either electronic or mechanical mechanisms.

It is therefore an object of the invention to at least substantially overcome the disadvantages of the prior art.

According to one aspect of the present invention, there is provided a method of developing a charge pattern on a moving arcuate imaging surface which comprises:

a. producing a stream of electrically charged droplets of substantially regular size and spacing, the droplets having a charge polarity opposite that of the charge pattern, the stream having a path substantially tangential to the imaging surface such that the droplets pass within less than about 0.020 inch of the surface;

b. providing deflecting electrodes on opposite sides of the stream in a plane parallel to the imaging surface; and c. applying an alternating electric voltage to the deflecting electrodes to deflect the charged droplets in a plane parallel with the imaging surface, said charged droplets having a charge sufficient to cause at least a portion of the droplets to be drawn to the imaging surface by the charge pattern thereon.

According to another aspect of the invention, there is provided an apparatus for developing a charge pattern on an arcuate imaging surface which comprises:

a. a means for producing a stream of charged droplets of substantially regular size and spacing positioned such that the stream has a trajectory substantially tangential to said imaging surface at a distance up to about 0.020 inches from the surface;

b. deflecting electrodes placed on either side of the stream of droplets in a plane parallel to the imaging surface; and c. a means for providing a source of alternating current connected to the deflecting electrodes to spread the stream in a plane parallel with the imaging surface.

Generally, such a method provides a liquid development of high resolution and good density of a charge pattern on an imaging surface. The method of the present invention at least tends to require a simple and relatively inexpensive apparatus and to avoid complex electrical or mechanical manupulation of the liquid droplet trajectory.

A marking method and apparatus according to the present invention will now be described by way of example and with reference to the accompanying drawings where:

FIG. 1 shows schematically and in cross-section the operation of the invention.

FIG. 2 shows schematically and in cross-section the arrangement for forming a uniform concentration of charged droplets near the imaging surface.

FIG. 3 shows in cross-section one possible use of the present invention in an electrostatographic copying device.

Referring more specifically now to FIG. 1, there is shown in cross-section a portion of an arcuate imaging surface 1 which is moving in the direction shown by the arrow. It is to be understood that in other embodiments the imaging surface may move in the opposite direction. Imaging surfaces capable of retaining a charge pattern are well known in the art and any suitable such imaging surface may be used. Typically such a surface is a layer of photosensitive material such as selenium, polyvinylcarbazole or zinc oxide supported on a conductive substrate. To make maximum advantage of the spread of charged droplets produced by the apparatus of the present invention, the imaging surface should preferably be arcuate and moving either in the same direction as the droplets or in the opposite direction. An imagewise charge pattern may be placed on the imaging surface in any of the well known methods. Such a charge pattern 2 is represented as a positively charged area on the imaging surface 1 of FIG. 1.

The charged liquid droplets 3 may be formed from any suitable liquid. Typical of such liquids are those having a resistivity of at least about $2 \times 10^2$ ohm. cm. and having a viscosity similar to that of water. Examples of such liquids are light weight mineral oil, water having an adjusted resistivity, alcohols and methylated spirits. Liquids having a viscosity of higher than about 2 cps. are formed into suitable droplets only with great difficulty. Liquids having a resistivity of less than about $2 \times 10^2$ ohm. cm. have a reduced ability to accept and retain a charge, and liquids with higher resistivity are more desirable. The liquid may be dyed or pigmented with any suitable material to enhance the developed image. Suitable dyes and pigments are well known in the art and include, for example, a wide range of carbon blacks and phthalocyanine blue pigments. A liquid which has been found to achieve good results in the present invention is light mineral oil having a viscosity of about 2 cps. pigments with carbon black.

Any suitable method of forming liquid droplets may be used. Typically such methods include nozzles and highly charged pin electrodes, both of which are well known in the art. Shown in FIG. 1 is a typical nozzle arrangement wherein the liquid developer is moved under pressure from a supply 4 through the nozzle orifice 5. Although any suitable pressure may be used, the liquid is typically maintained under a pressure of from about 50 psi to 60 psi.

The nozzle shown in FIG. 1 is surrounded by an oscillator coil 6. Oscillator coils are well known in the art as a means for producing a regular stream of droplets from a nozzle such as the one shown in FIG. 1. Typical oscillator coils are piezoelectric crystals which produce small, high frequency movement of the nozzle when they are under the influence of an electric charge. Such high frequency movement of the nozzle has the effect of breaking the stream emitting from the nozzle into droplets of regular size and spacing at a point outside the nozzle oriface. Any suitable oscillator frequency is useful in the present invention. Typically, the oscillator frequency ranges from about 5 to about 200 K Hz.

Oscillator frequencies of less than about 5 K Hz tend to produce droplets so large as to be undesirable for developing a charge pattern with high resolution. Oscillator frequencies of more than about 200 K Hz tend to produce such small droplets that they do not posses sufficient mass to have a predictable trajectory. Such small droplets often form a fine spray which may not be useful in the present invention.

The useful orifice size in the nozzle varies depending upon the pressure under which the liquid moves and the frequency of the oscillator coil. Useful charged droplets have been produced with nozzle orifices ranging in size from about 0.010 inch to about 0.002 inch when used in combination with pressures ranging from about 50 to about 60 psi and oscillator coil frequencies ranging from about 5 to about 200 K Hz. It is to be understood, however, that a broader range of nozzle oriface diameters could be used in combination with a broader range of pressures and oscillator coil frequencies.

The stream of liquid coming out of the nozzle orifice 5 of FIG. 1 breaks into droplets of regular size and spacing at a point outside the nozzle. At such a point, charging means 7 is placed so as to apply a charge to the droplets as they are formed. Any suitable charging means may be used to charge the liquid droplets to a charge opposite in polarity to that of the charge pattern. Typically the charging means is an electrode or corotron placed with the effective proximity of the point at which the stream of liquid emanating from the nozzle orifice 5 breaks into droplets. In FIG. 1, the charging means is an electrode comprising a conductive metal plate having a hole through which the stream and droplets pass.

Any suitable charge may be placed on the electrode to charge the stream and the droplets which break therefrom. Typically the electrode is charged to at least about 100 v. Such a charge on the electrode will result in an equal charge of opposite polarity on the liquid stream and on the droplets. Although, a charge of 100 v is useful, a larger charge is generally preferred to increase the attraction between the charge pattern on the imaging surface and the charged droplet. Charges of strengths up to that required to cause air breakdown may be used.

The charged droplet then moves between a pair of deflection electrodes 8 which are charged with an alternating current. An alternating current of any suitable frequency and strength may be used. Typically the current frequency is 50 or 60 Hz and the strength of the current is typically not more than about 16,000 v/cm although, it is understood that any current strength which will not cause sparking may be used. Although a relatively low charge may be used on the charging means 7, and a relatively high alternating current may be applied to the deflection electrodes 8, a more typical embodiment uses a somewhat higher charge on the charging means 7 and a low current is applied to the deflection electrodes 8; for example, in one embodiment, the charging means is charged to about 800 v and the deflection electrode is subject to a current of about 2,000 v/cm. Although it is not intended to be a limitation, a guideline for useful combinations of charges on the charging means 7 and the deflecting electrodes 8 is that their numerical product should be about equal to the numerical product of the minimum useful charge on the charging means 7 and the maximum useful charge on the deflection electrodes 8.

The alternating current applied to the deflecting electrodes 8 causes the charged droplets to deflect horizontally into a fan-like pattern so that at the point of closest tangency to the imaging surface 1, there is a horizontal spread of droplets available to develop the charge pattern 2. Droplets in the proximity of the charge pattern 2 are attracted to the imaging surface 1 where they remain in imagewise fashion. Development of good resolution and density may be observed. Droplets which are not so attracted pass beyond the imaging surface 1 and may be collected by a gutter 9 as shown in FIG. 1.

The point of closest proximity of the droplet paths to the imaging surface should generally be about 0.020 inch or less in order to develop imaging surfaces typical to those used in an electrostatographic copying device, although greater distances may be useful when a more highly charged surface is sought to be developed. Best results in developing typical charge patterns on typical electrostatographic imaging surfaces when the average droplet path is about 0.005 inch from the imaging surface at its point of closest proximity. Droplet paths which come within less than about 0.002 inch of the commonly available imaging surfaces run a risk of striking the imaging surface in non-image areas because of the uneven surface of such imaging surfaces. However, the use of imaging surfaces made to closer tolerances would allow the use of a droplet path which is closer to the imaging surface than 0.002 inch at its closest point.

Although it is possible for only one such means for producing charged droplets to be used, particularly in connection with narrow imaging surfaces, a plurality of such means may be used to produce a substantially uniform array of droplets which are available across the imaging surface to develop a charge pattern thereon.

Referring more specifically now to FIG. 2 there is shown in cross-section and from a top view, a plurality of means for producing an array of charged droplets as described in connection with FIG. 1. Each nozzle is arranged so as to produce an array of charged droplets which overlap a portion of the area covered by the array of the adjacent nozzle. Such an arrangement may be expected to provide a substantially uniform concentration of charged droplets at the point of closest tangency between the trajectory of the droplets and the imaging surface. The effect of the alternating current applied to the deflecting electrodes is such that the charged droplets do not collide in the overlaping trajectories of the adjacent nozzles. Although, not completely understood, it is believed the trajectory of each individual droplet is improved by the spreading effect of the alternating current because each droplet moves through relatively undisturbed air.

The distance between the nozzle orifice 5 and the point of closest tangency with the imaging surface and the distances between the nozzles themselves may be adjusted to optimum conditions. In one embodiment which produces good results, the nozzle orifices 5 are placed 2 inchs away from the point of closest tangency of the droplet path to the imaging surface and the nozzles were spaced about $\frac{3}{8}$ inch apart.

Referring more specifically now to FIG. 3, there is shown schematically in cross-section an electrostatographic copying device using the development method of the present invention. Cylindrical imaging surface 10 which is a photoconductive layer supported on a conductive substrate moves in the direction indicated. Charging means 11, which in this embodiment is a corotron, places a uniform charge on the imaging surface.

The surface is then exposed to a light and dark image at imaging station 12 where the uniform charge is dissipated in the light struck areas, leaving an imagewise charge in the non-light struck areas in well known electrostatographic fashion. As the imaging surface moves in the direction shown, the charge pattern is brought into a developing relationship with the charged liquid droplets at development station 13 as described in detail in connection with FIGS. 1 and 2. The charge pattern is thus developed onto the imaging surface. Although the imaging surface may be the final copy in some electrostatographic devices, the device shown in FIG. 3 provides for the transfer of the image to an image receiving surface 14, which may be plain paper, at transfer station 15. The imaging surface is then cleaned by any suitable cleaning means at cleaning station 16 to be made suitable for reuse.

In addition to the steps used to carry out the process of the present invention, other steps or modifications may be used if desirable. In addition, other materials may be incorporated in the system of the present invention which will enhance, synergize or otherwise desirably affect the properties of the systems for their present use.

Anyone skilled in the art will have other modifications occur to him based on the teachings of the present invention. These modifications are intended to be encompassed within the scope of this invention.

What is claimed is:

1. A method of developing a charge pattern on a moving arcuate imaging surface which comprises:

a. producing a stream of electrically charged droplets of substantially regular size and spacing, the droplets having a charge polarity opposite that of the charge pattern, the stream having a path in a plane substantially parallel to a tangent to the imaging surface such that the droplets pass within less than about 0.020 inch of the surface;

b. providing deflecting electrodes on opposite sides of the stream in said plane substantially parallel to said tangent to said imaging surface; and c. applying an alternating electric voltage to the deflecting electrodes to deflect the charged droplets in said plane, said charged droplets having a charge sufficient to cause at least a portion of the droplets to be drawn to said imaging surface by the charge pattern thereon.

2. The method of claim 1, wherein a plurality of streams of droplets are provided in said plane substantially parallel to said tangent to said imaging surface so that the trajectory of the droplets from adjacent streams overlap in such a way as to produce a substantially uniform concentration of droplets in the proximity of the imaging surface.

3. The method of claim 1, wherein the droplets are charged to a potential of at least about 100 v.

4. The method of claim 1, wherein the deflecting electrodes are charged with an alternating current of less than about 16 Kv.

5. The method of claim 1, wherein the alternating current has a frequency of from about 50 to about 60 Hz.

6. The method of claim 1, wherein the droplets are formed from a liquid having a resistivity of at least about $2 \times 10^2$ ohm. cm. and a viscosity of not more than about 2 cps.

7. The method of claim 6, wherein the liquid is selected from a group consisting of light mineral oil, alcohol, methylated spirit and water having an adjusted resistivity.

8. The method of claim 6, wherein the droplets are colored with a colorant selected from the group consisting of dyes and pigments.

9. The method of claim 1, wherein the droplets are produced by an ink jet nozzle.

10. The method of claim 9, wherein the ink jet nozzle has an orifice of from about 0.010 inch to about 0.002 inch, is operated at a liquid pressure of from about 50 to 60 psi and is oscillated by a piezoelectrical crystal at a frequency of from about 5 to about 200 K Hz.

11. The method of claim 1, wherein the developed image is subsequently transferred to an image receiving surface.

12. The method of claim 11, wherein the imaging surface is reused at least once.

13. An apparatus for imaging a droplet pattern comprising:

a. an arcuate imaging surface;

b. first means for producing a stream of charged droplets of substantially regular size and spacing, said first means being positioned such that said droplet stream produced thereby has a trajectory in a plane substantially parallel to a tangent to said arcuate imaging surface at a distance up to about 0.020 inches from said arcuate imaging surface;

c. deflecting electrodes located on either side of said stream of charged droplets in said plane substantially parallel to said tangent to said arcuate imaging surface; and d. second means coupled to said deflecting electrodes for providing an alternating current signal to said deflecting electrodes to spread said stream of charged droplets in said plane substantially parallel to said tangent to said arcuate imaging surface.

14. The apparatus of claim 13, wherein the means for producing a stream of charged droplets comprises an ink jet nozzle which is actuated by an oscillator coil and a charged electrode positioned in the effective proximity of the point at which the stream from the nozzle breaks into droplets.

* * * * *